US006640760B1

(12) United States Patent
Plasencia

(10) Patent No.: US 6,640,760 B1
(45) Date of Patent: Nov. 4, 2003

(54) CAMSHAFT REARRANGING DEVICE

(76) Inventor: Pedro A. Plasencia, C/Llano Verde-Res.Aries Apartment 52, Caracas Miranda (VE)

( * ) Notice: Subject to any disclaimer, the term of this patent is extended or adjusted under 35 U.S.C. 154(b) by 0 days.

(21) Appl. No.: 10/150,033

(22) Filed: May 17, 2002

(51) Int. Cl.[7] ..... F01L 1/34

(52) U.S. Cl. ..... 123/90.17; 123/90.15; 123/90.31; 464/1; 464/161; 464/162

(58) Field of Search ..... 123/90.17, 90.15, 123/90.31; 464/1, 2, 160–166

(56) References Cited

U.S. PATENT DOCUMENTS 5,326,321 A * 7/1994 Chang ..... 464/2
5,381,764 A * 1/1995 Fukuma et al. ..... 123/90.17
5,592,909 A * 1/1997 Tsuruta ..... 123/90.17
5,803,030 A * 9/1998 Cole ..... 74/568 R
5,860,328 A * 1/1999 Regueiro ..... 123/90.17
6,167,854 B1 * 1/2001 Regueiro ..... 123/90.17
6,199,522 B1 * 3/2001 Regueiro ..... 123/90.15

* cited by examiner

*Primary Examiner*—Thomas Denion
*Assistant Examiner*—Kyle Riddle
(74) *Attorney, Agent, or Firm*—Walker, McKenzie & Walker, P.C.

(57) ABSTRACT

A camshaft rearranging device for an internal combustion engine including a crankshaft and a camshaft having a longitudinal axis. The camshaft rearranging device includes first or internal part aligned with the longitudinal axis of the camshaft and jointed to the camshaft for rotating the camshaft; a second or external part aligned with the longitudinal axis of the camshaft and joined to the crankshaft for being rotated by the crankshaft; and a third or intermediate part aligned with the longitudinal axis of the camshaft and joining the first and second parts to one another for rotating the first part when the second part is rotated and for rotating the first part relative to the second part.

4 Claims, 6 Drawing Sheets

CAMSHAFT REARRANGING DEVICE

BACKGROUND OF THE INVENTION

1. Field of the Invention

The present invention relates, in general, to internal combustion engines, and in particular, to a device for rearranging the camshaft of an internal combustion engine.

2. Background Art

A typical internal combustion engine includes an engine block, a plurality of pistons reciprocatingly mounted within cylinders in the engine block, a crankshaft coupled to the pistons for being rotated by the reciprocation of the piston, and a camshaft rotatably driven by the crankshaft of the engine through either a belt drive (commonly called a timing belt) or a chain drive (commonly called a timing chain), etc. As the camshaft rotates, cam lobes fixed to the camshaft push directly or indirectly against rocker arms that press down on cylinder valves (i.e., the intake, or admission, and exhaust valves), causing the valves to open. Further rotation of the camshaft allow springs to return the valves to closed position. The design of the cam lobes (e.g., the profile and position of the cam lobes) determine, among other things, when the valves open, the length of time the valves are held open, etc.

In a standard four-stroke cycle engine, a single cycle of operation (intake, compression, power, and exhaust) takes place over four strokes of a piston, made in two crankshaft revolutions. When a piston is at the top of the cylinder at the beginning of the intake stroke, the intake valve opens and the descending piston draws in the air-fuel mixture. At the bottom of the stroke, the intake valve closes and the piston starts upward on the compression stroke. Just before or as the piston reaches the top again, the compressed air-fuel mixture is ignited by the firing of a spark plug, etc., forcing the piston down on its power stroke. As the piston reaches the bottom of its stroke, the exhaust valve opens, allowing combustion products to be forced out through the exhaust valve.

Some internal combustion engines use dual camshafts, one to operate the intake (admission) valves and the other to operate the exhaust valves. Both of the camshafts in a dual camshaft engine can be driven by a single crankshaft-powered chain drive or belt drive, etc.

The performance of an internal combustion engine can be improved by changing the positional relationship of a camshaft relative to the crankshaft. For example, the camshaft can be "retarded" for delayed closing of intake valves or "advanced" for early closing of intake valves. In a dual-camshaft engine, retarding or advancing the camshaft can be accomplished by changing the positional relationship of one of the camshafts, usually the camshaft that operates the intake valves of the engine, relative to the other camshaft and the crankshaft. Accordingly, retarding or advancing the camshaft varies the timing of the engine in terms of the operation of the intake valves relative to the exhaust valves, or in terms of the operation of the valves relative to the position of the crankshaft.

Certain internal combustion engines manufactured by Honda (Honda Giken Kogyo Kabushiki Kaisha of Tokyo, Japan) include an electronic and mechanical system to vary the valve timing. Such engines (called VTEC or Variable Valve Timing and Lift Electronic Control engines) have an extra intake cam and associated rocker. The extra cam is designed to keep the intake valve open longer than the standard cam. At low engine speeds, the extra rocker is not connected to any valve. At high engine speeds, some means secures the extra rocker to the rockers that control the intake valves.

Some internal combustion engines manufactured by Ferrari (Ferrari S.p.A. of Modena, Italy) include means to advance the valve timing to selectively cause the valves to open and close later. For example, if the intake valves normally open at 10 degrees before top dead center (TDC) and close at 190 degrees after TDC, the Ferrari mechanism can open the valves at 10 degrees after TDC and close the valves at 210 degrees after TDC. This is done with a cam lobe having a profile that varies along its length. At one end of the cam lobe is the least aggressive cam profile, and at the other end is the most aggressive. The valve timing is changed by sliding the camshaft laterally so that different parts of the cam lobe engages the rocker arm, etc.

Other manufacturers are reportedly working with systems using a solenoid on each valve to open and close that valve under computer control rather than using a camshaft, etc.

Nothing in the known prior art discloses or suggests the present invention. More specifically, nothing in the known prior art discloses or suggests a camshaft rearranging device including first means for fixed attachment to the camshaft of an internal combustion engine so that rotation of the first means will cause the camshaft to rotate; second means for being rotated by the crankshaft of the internal combustion engine; and third means joining the first and second means to one another so that the first means will rotate when the second means is rotated by the crankshaft and for rotating the first means relative to the second means to rearrange the positional relationship of the camshaft relative to the crankshaft.

BRIEF SUMMARY OF THE INVENTION

The present invention is a camshaft rearranging device for an internal combustion engine including a crankshaft and a camshaft having a longitudinal axis. The camshaft rearranging device of the present invention includes first means for fixed attachment to the camshaft of an internal combustion engine so that rotation of the first means will cause the camshaft to rotate; second means for being rotated by the crankshaft of the internal combustion engine; and third means joining the first and second means to one another so that the first means will rotate when the second means is rotated by the crankshaft and for rotating the first means relative to the second means to rearrange the positional relationship of the camshaft relative to the crankshaft.

It is an object of the present invention to allow the driver of a motor vehicle to vary the valve timing of the engine so as to maximize engine performance at different RPM's.

It is another object of the present invention to allow the driver of a motor vehicle to so vary the valve timing by rotating the camshaft a few degrees relative to the crankshaft. For example, if the intake valves of the engine of a motor vehicle normally open at 10° before top dead center (TDC) and close at 190° after TDC, for total open duration of 200°, the present invention allows the driver to rotate the camshaft ahead a few degrees relative to the crankshaft, thereby shifting the opening and closing times so that the valve might open at 10° after TDC and close at 210° after TDC.

DETAILED DESCRIPTION OF THE INVENTION

Figure 1:
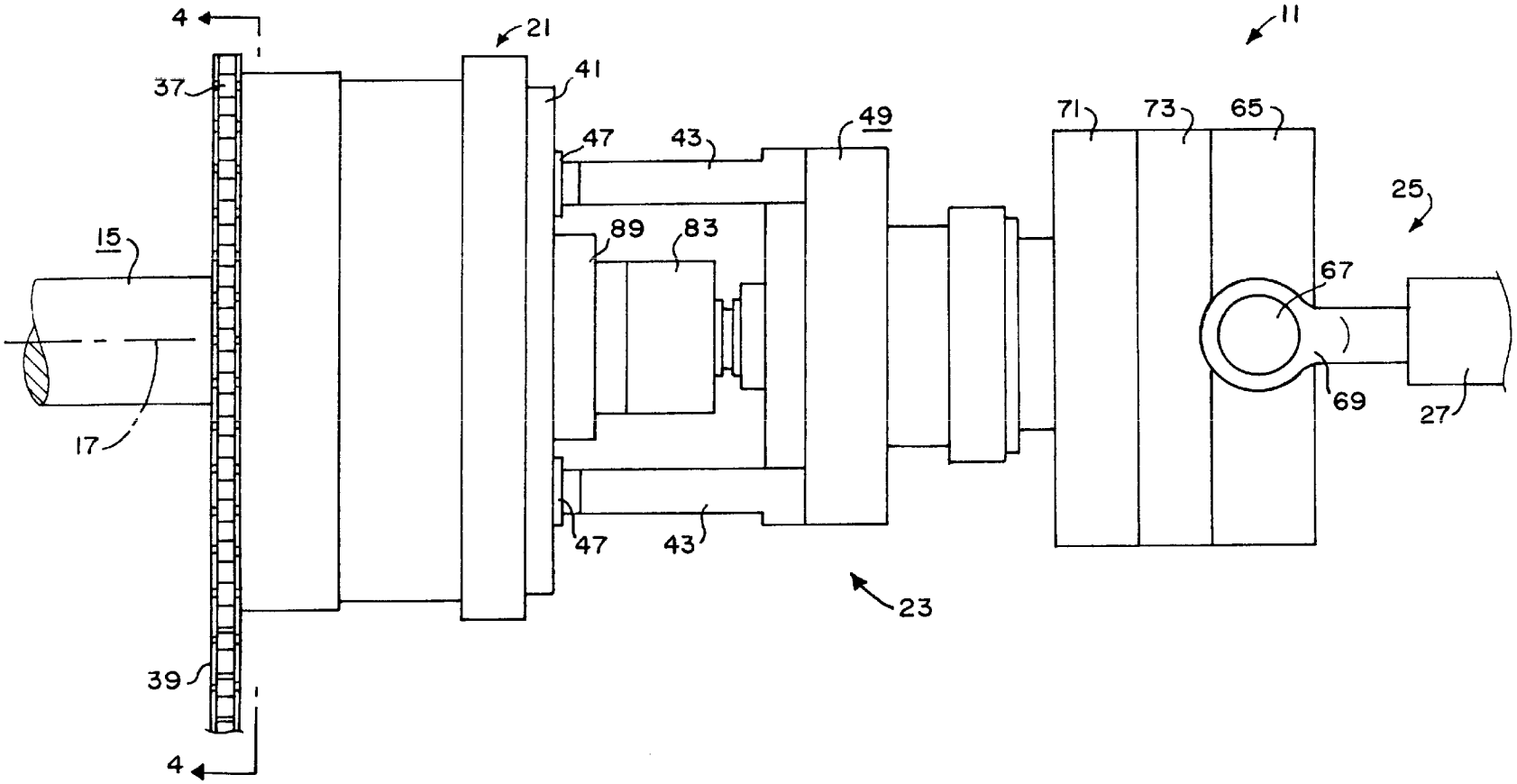
FIG. 1 is a somewhat diagrammatic side elevational view of the camshaft rearranging device of the present invention.
Figure 2:
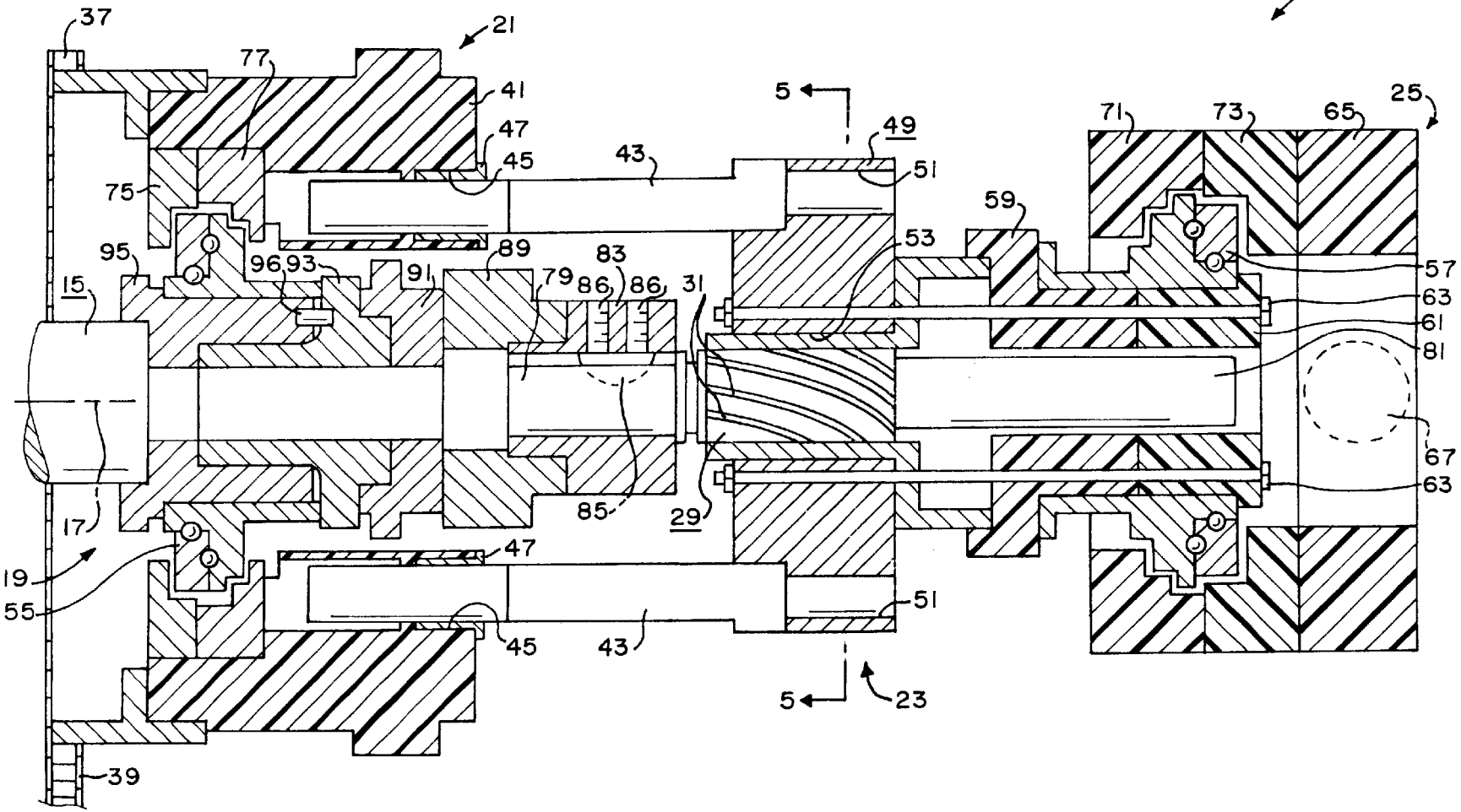
FIG. 2 is a somewhat diagrammatic longitudinal section view of the camshaft rearranging device of the present invention.
Figure 3:
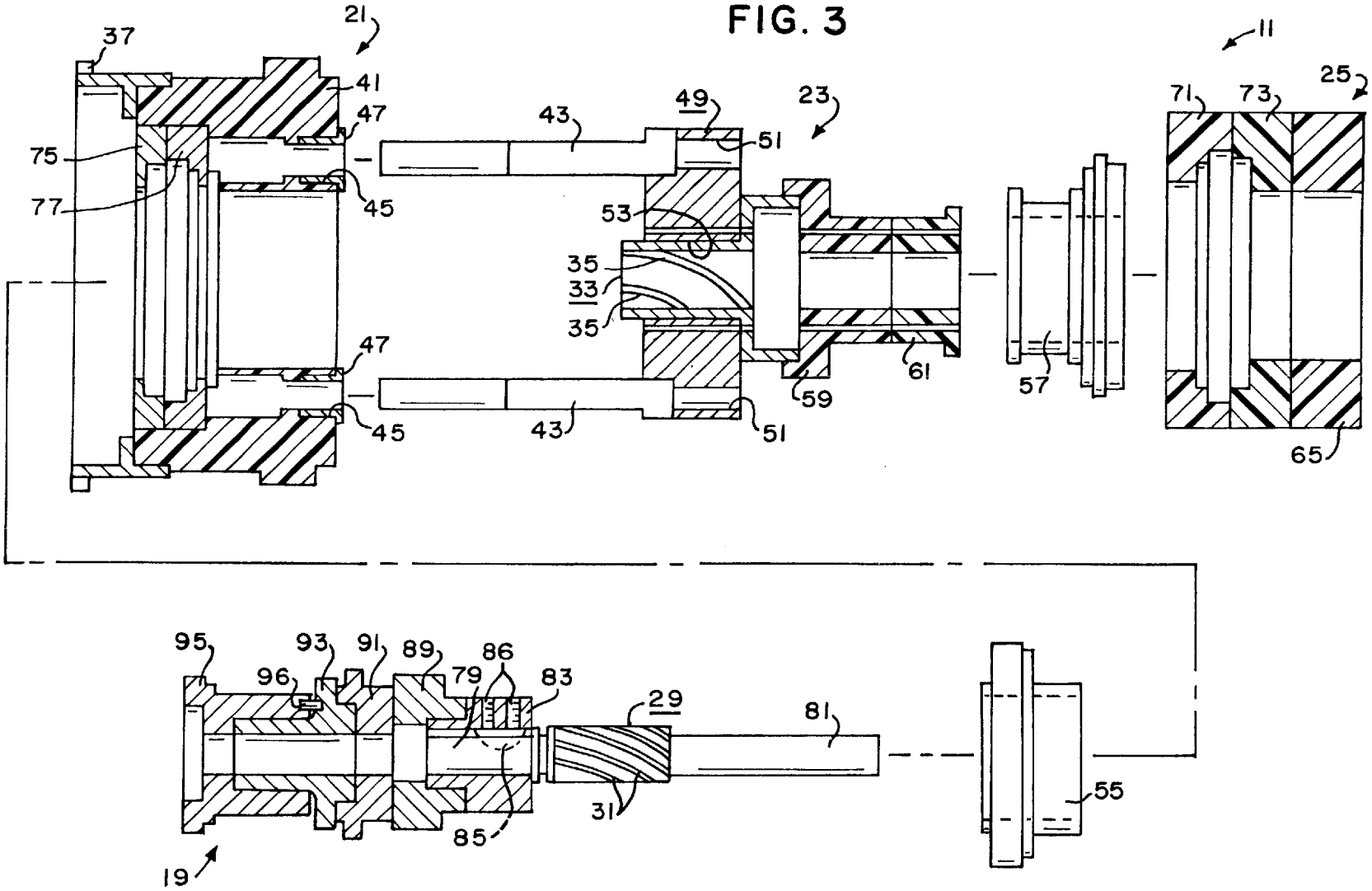
FIG. 3 is a somewhat diagrammatic exploded longitudinal section view of the camshaft rearranging device of the present invention.

A preferred embodiment of the camshaft rearranging device of the present invention is shown somewhat diagrammatically in the drawings, and identified by the numeral 11. The camshaft rearranging device 11 is designed for use in combination with a typical internal combustion engine of a vehicle (e.g., an automobile), the internal combustion engine including a crankshaft 13 and a camshaft 15 having a longitudinal axis 17.

The camshaft rearranging device 11 includes first means 19, preferably in alignment with the longitudinal axis 17 of the camshaft 15, for being fixedly attached or joined to the camshaft 15 so that rotation thereof will cause the camshaft 15 to likewise rotate; second means 21, preferably in alignment with the longitudinal axis 17 of the camshaft 15, for being rotated by the crankshaft 13; and third means 23, preferably in alignment with the longitudinal axis 17 of the camshaft 15, for joining the first and second means 19, 21 to one another so that the first means 19 will rotate when the second means 21 is rotated by the crankshaft 13 and for rotating the first means 19 relative to the second means 21 to rearrange the positional relationship of the camshaft 15 relative to the crankshaft 13.

The camshaft rearranging device 11 is preferably designed so that longitudinal movement of the third means 23 relative to the first means 19 causes rotation of the first means 19 relative to the second means 21, and preferably includes fourth means 25 for causing longitudinal movement of the third means 23. The fourth means 25 may include any of various motive power means for applying a longitudinal force to the third means 23 such as, for example, a fluid cylinder means including a hydraulic piston 27 connected to the third means 23, and valves or other controls (not shown) for being operated by the driver of the vehicle, mechanical linkage (not shown) including levers connected to the third means 23, and controls (not shown) for being operated by the driver of the vehicle, etc.

The first means 19 preferably includes a first means gear member 29 having one or more (preferably three) spiral teeth 31, and the third means 23 preferably includes a third means gear member 33 having one or more (preferably at least three) spiral teeth 35 for coacting with the spiral teeth 31 of the first means gear member 29 so that longitudinal movement of the third means gear member 33 relative to the first means gear member 29 will cause rotation of the first means gear member 29. The first means gear member 29 may be machined or otherwise constructed as a central shaft with spiral teeth out of carbon steel or the like. The third means gear member 33 may be machined or otherwise constructed out of carbon steel or the like, as a ring with spiral teeth.

Figure 4:
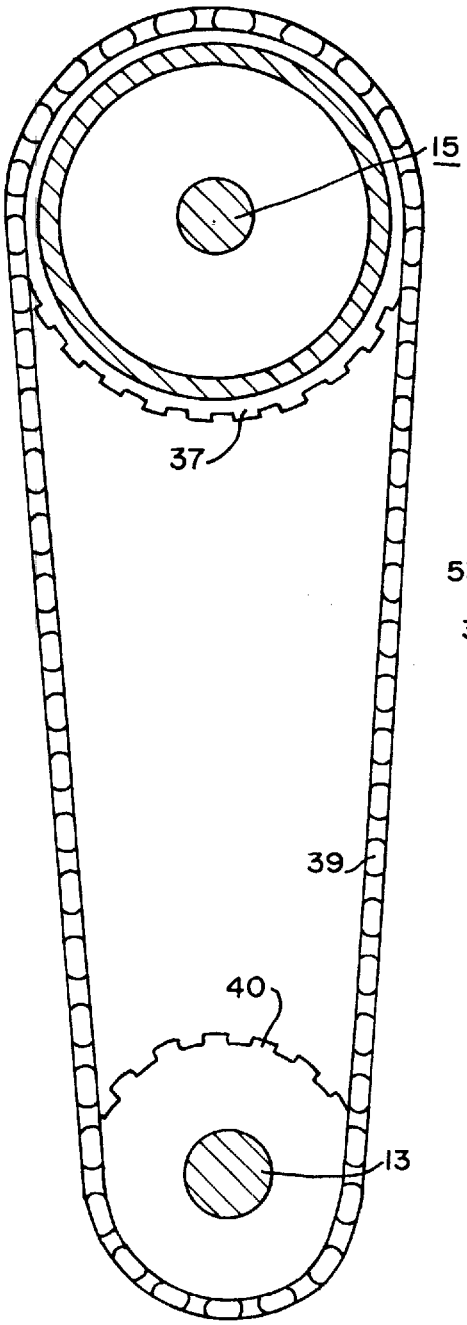
FIG. 4 is a somewhat diagrammatic sectional view substantially as taken on line 4—4 of FIG. 1, with portions added and omitted for clarity.
Figure 5:
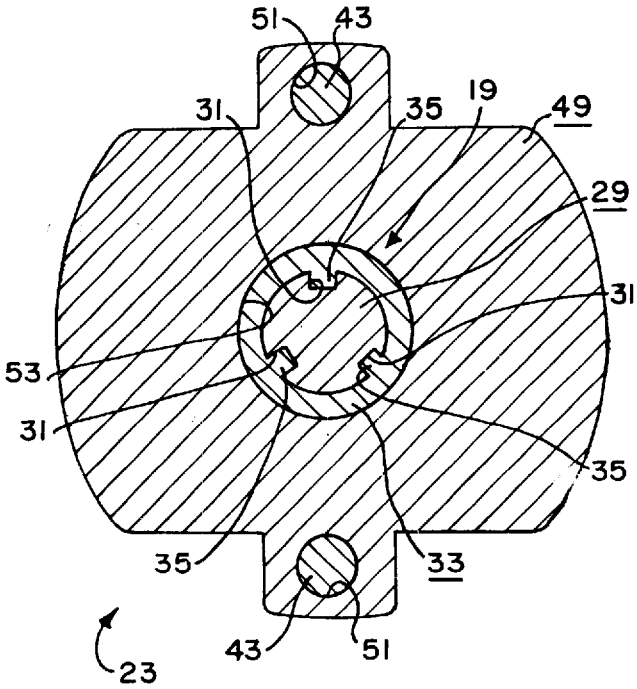
FIG. 5 is a somewhat diagrammatic sectional view substantially as taken on line 5—5 of FIG. 2, with portions omitted for clarity.
Figure 6:
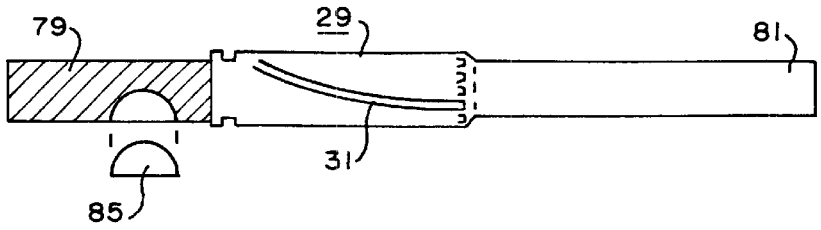
FIG. 6 is a somewhat diagrammatic, partially sectional plan view of a first means gear member of the camshaft rearranging device of the present invention.
Figure 7:
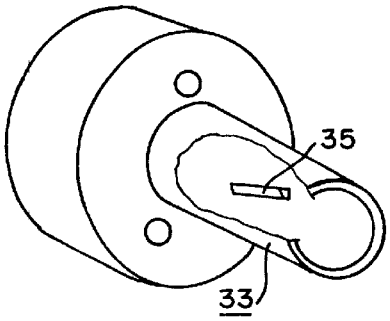
FIG. 7 is a somewhat diagrammatic perspective view of a third means gear member and associated structure of the camshaft rearranging device of the present invention.
Figure 8:
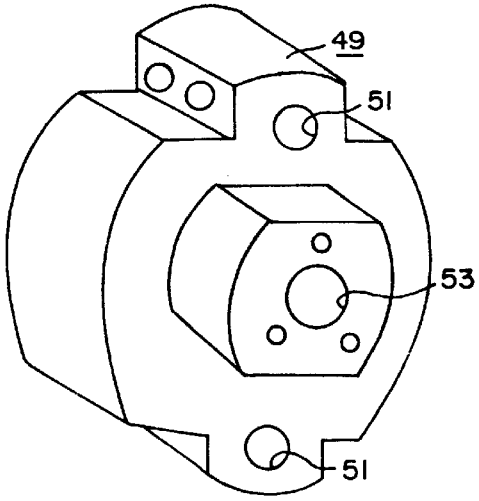
FIG. 8 is a somewhat diagrammatic perspective view of a body member of a third means of the camshaft rearranging device of the present invention.
Figure 9:
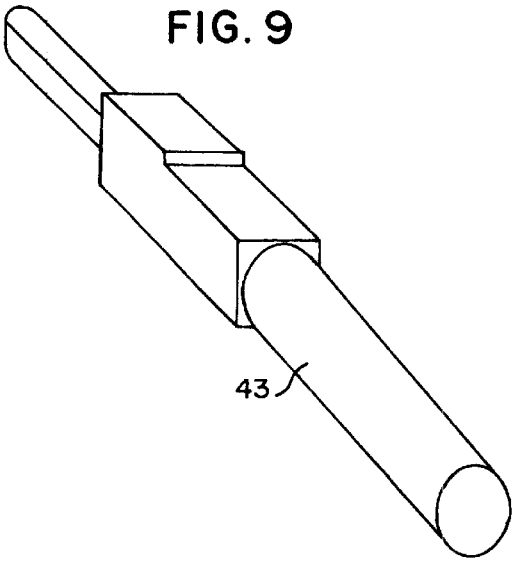
FIG. 9 is a somewhat diagrammatic perspective view of a guide of the third means of the camshaft rearranging device of the present invention.
Figure 10:
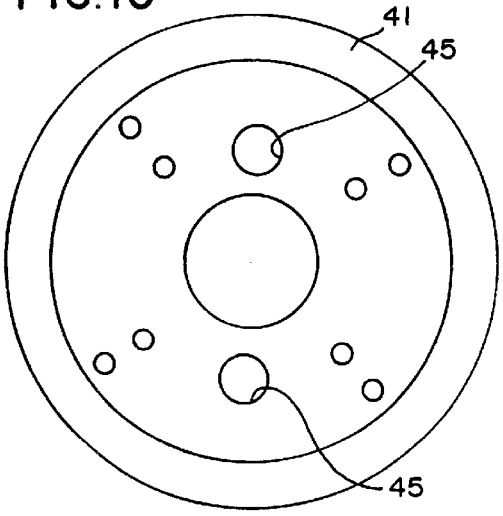
FIG. 10 is a somewhat diagrammatic face view of a ring member of a second means of the camshaft rearranging device of the present invention.
Figure 11:
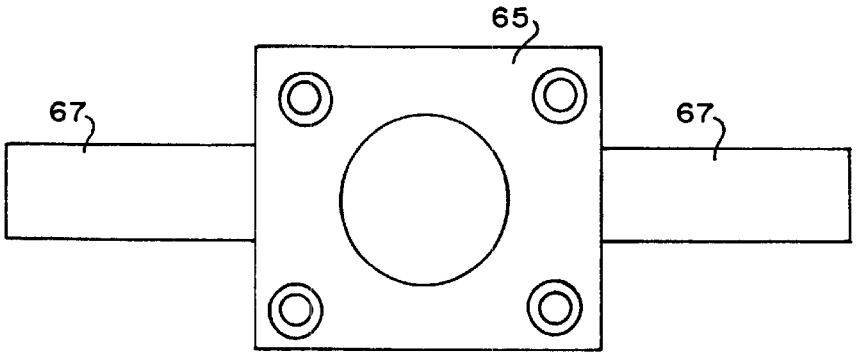
FIG. 11 is a somewhat diagrammatic face view portions of a fourth means of the camshaft rearranging device of the present invention.
Figure 12:
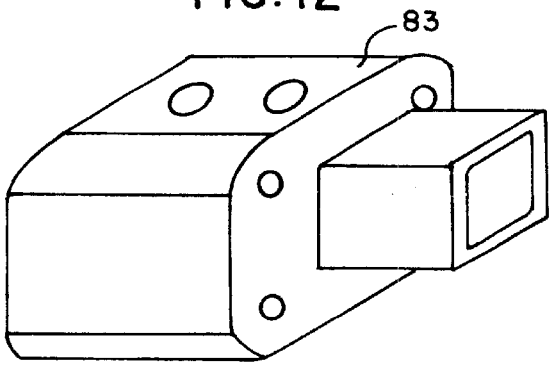
FIG. 12 is a somewhat diagrammatic perspective view of a first connector of a first means of the camshaft rearranging device of the present invention.
Figure 13:
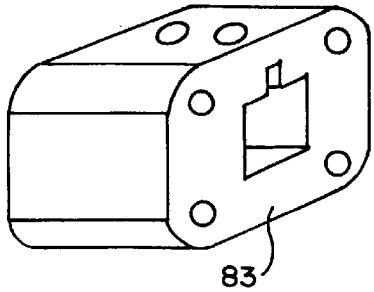
FIG. 13 is a somewhat diagrammatic perspective view of the first connector of FIG. 12, taken from the opposite end.
Figure 14:
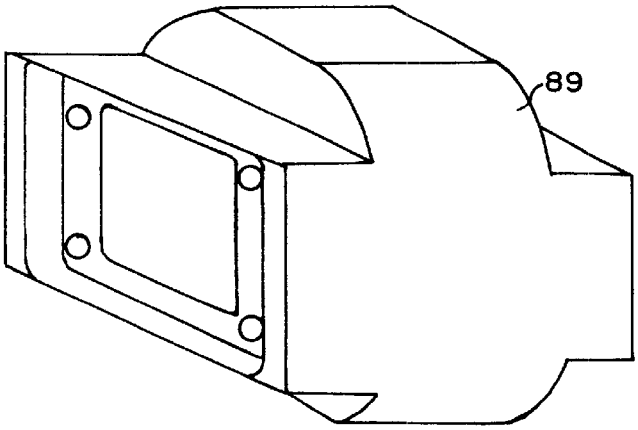
FIG. 14 is a somewhat diagrammatic perspective view of a second connector of the first means of the camshaft rearranging device of the present invention.

The second means 21 preferably includes a wheel member 37 forming an external pulley or sprocket for being drivably engaged by a timing belt or chain 39 that is driven by a pulley or sprocket 40, etc., mounted on the crankshaft 13 (see, for example, FIG. 4). Thus, the wheel member 37 may have external teeth for use with a timing chain or an external groove for use with a timing belt, etc., as will now be apparent to those skilled in the art. The wheel member 37 is preferably machined or otherwise constructed out of carbon steel or the like.

The second means 21 preferably includes a body or ring member 41 to which the wheel member 37 is fixedly attached. The ring member 41 may be machined or otherwise constructed out of nylon or the like.

The third means 23 is preferably secured to the second means 21 in a manner which prevents rotation of the third means gear member 33 relative to the second means 21 and which allows longitudinal movement of the third means gear member 33 relative to the second means 21. For example, the third means 23 includes a plurality of spaced apart male members or guides 43, and the second means 21 may have a plurality of spaced apart female members or apertures 45 in the ring member 41 for slidably receiving the proximal ends of the guides 43 of the third means 23 to secure the second and third members 21, 23 together in a manner which allows longitudinal movement of the third means 23 relative to the second means 21 while restricting or preventing rotation of the third means 23 relative to the second means 21. The guides 43 may be machined or otherwise manufactured out of carbon steel or the like. Bushings 47 are preferably provided between the guides 43 and apertures 45. The bushings 47 may be machined or otherwise manufactured out of bronze or the like.

The third means 23 preferably includes a move brick or body member 49 for joining the third means gear member 33 to the guides 43. For example, the body member 49 may have holes 51 therein for receiving the proximal ends of the guides 43 with the guides 43 being fixedly attached thereto via set screws (not shown) or the like, and a central opening 53 for receiving the third member gear member 33. The body member 49 may be machined or otherwise constructed out of carbon steel or the like.

The camshaft rearranging device 11 preferably includes a first bearing assembly 55 positioned between the first means 19 and the second means 21 for allowing substantially unrestricted rotation between the first means 19 and the second means 21, and a second bearing assembly 57 positioned between the third means 23 and the fourth means 25 for allowing substantially unrestricted rotation between the third means 23 and the fourth means 25. The first and second bearing assemblies 55, 57 may consist of off-the-shelf type ball bearing assemblies as will now be apparent to those skilled in the art.

The third means 23 preferably includes first and second containment or keeper members 59, 61 for coacting together to prevent or restrict longitudinal movement of the second bearing assembly 57 relative to the third means 23. The first and second keeper members 59, 61 may be machined or otherwise manufactured out of nylon or the like.

The third means 23 preferably includes a plurality of bolt means 63 for extending through the body member 49, third means gear member 33, first keeper member 59, and second keeper member 61 for securing those parts to one another.

The fourth means 25 preferably includes a body or ring member 65 including coupling means 67 for being coupled to the motive power means such as, for example, stub axles or pins covered by protective bushings made of bronze or the like for being coupled to the clevis 69 of the hydraulic piston 27 (see FIG. 1). The body member 65 may be machined or otherwise manufactured out of nylon.

The fourth means 25 preferably includes first and second containment or keeper members 71, 73 for coacting together to prevent or restrict longitudinal movement of the second bearing assembly 57 relative to the fourth means 25. The first and second keeper members 71, 73 may be machined or otherwise manufactured out of nylon or the like.

The fourth means 25 may include a plurality of bolt means (not shown) for extending through the body member 65, first keeper member 71, and second keeper member 73 for securing those parts to one another.

The second means 21 preferably includes first and second containment or keeper members 75, 77 for coacting together to center the first bearing assembly 55 relative to the ring member 41, etc. The first and second keeper members 75, 77 may be machined or otherwise manufactured out of bronze or the like.

The second means 21 may include a plurality of bolt means (not shown) for extending through the first keeper member 75, second keeper member 77, and the ring member 41 for securing those parts to one another.

The first means gear member 29 preferably consist of an elongated shaft having a first end 79 and a second end 81, with the spiral teeth 31 formed in the midportion thereof.

The first means 19 preferably includes a first connector member 83 for being fixed to the first end 79 of the first means gear member 29 via a tongue or key 85, grooves or slots for the key 85 in both the first end 79 and the first connector member 83, and set screws 86 extending through the first connector member 83 to the key 85, etc., as will now be apparent to those skilled in the art. The first connector member 83 may be machined or otherwise constructed out of carbon steel or the like.

The first means 19 may include a second connector member 89 for connecting to the first connector member 83, a third connector member 91 for connecting to the second connector member 89, a fourth connector member 93 for connecting to the third connector member 91, and a fifth connector member 95 for connecting to the fourth connector member 93. The second, third, fourth and fifth connector members 89, 91, 93, 95 may be machined or otherwise constructed out of carbon steel or the like.

The first means 19 may include a plurality of bolt means (not shown) for securing the first connector member 83, second connector member 89, third connector member 91 and fourth connector member 93 to one another. Pins 96 may extend between the fourth and fifth connector members 93, 95 for non-rotatably joining the fourth and fifth connector members 93, 95 together. The fourth and fifth connector members 93, 95 may be non-rotatably pinned and press fitted to one another. The fourth and fifth connector members 93, 95 coact to form containment or keeper means for the first bearing assembly 55 and restrict longitudinal movement of the second means 21 relative to the first means 19 through the first bearing assembly 55 while allowing rotation of the second means 21 about the first means 19 through the first bearing assembly 55 via the first and third means gear members 29, 33, etc.

The third, fourth and fifth connector members 91, 93, 95 have a central aperture desired to be non-rotatably secured to one end of the camshaft 15 so that the camshaft 15 will be rotated when the crankshaft 13 causes the second means 21 to rotate via the coaction between the timing belt or chain 39 and the wheel member 37, thereby causing the third means 23 to rotate via the coaction between the ring member 41 and the guides 43, thereby causing the first means 19 to rotate via the coaction between the first and third means gear members 29, 33 as will now be apparent to those skilled in the art. The driver of the vehicle can then advance or retard the valve timing by merely activating the motive power means of the fourth means 25 (e.g., the hydraulic piston 2 to apply a longitudinal force to the third means 23 and cause the second means 21 to rotate slightly relative to the first means 19 about the longitudinal axis 17 of the camshaft 15 via the coaction between the first and third means gear members 29, 33 and the coaction between the ring member 41 and the guides 43, etc., as will now be apparent to those skilled in the art.

As thus constructed, the camshaft rearranging device of the present invention provides a mechanical device able to rearrange the camshaft of an internal combustion engine to allow high horsepower and high torque at high revolutions per minute (rpm), and high power, high torque, less fuel consumption and smooth idle speed at low rpm. The camshaft rearrange device is composed of a first or internal part or means for being connected or joined to the camshaft, a second or external part or means for on which the timing belt or chain from the crankshaft go, and a third or intermediate part or means for joining the first and second means in a manner which allows the first or internal and second or external parts to move with different velocities, which produces a rotational movement in the first or internal part when longitudinal force is applied to third or intermediate part, which is capable of rearranging the camshaft while the engine is working, etc. A primary purpose of rearranging the camshaft is to change the angle between intake or admission and exhaust cams, because the angle between the intake and exhaust cams plays an important role in the amount of fuel-air mixture that enters the piston cylinder. Depending on whether the cam opens the intake valve earlier or later, it allows more or less quantity of fuel-air mixture. For example, an engine with an angle between the intake or admission cams and the exhaust cams of 114° typically has high power and high torque at low rpm, and good idle speed. On the other hand, an engine with an angle between the intake or admission cams and the exhaust cams of 108° typically has high power and high torque at high rpm. When the intake cam opens the intake valve earlier, the exhaust valve does not close completely, and the exhaust gases escape through the exhaust valve, creating a vacuum. This vacuum boost the intake gases (fuel-air mixture) and allows bigger quantities of intake gases to enter the piston cylinder. That is exactly what is needed at high rpm, because it is required to fill the piston cylinder with fuel-air mixture as much as possible to get a more efficient combustion process. When the intake cam opens the intake valve earlier at low rpm, part of the intake gases escape through the exhaust valve because it does not close completely and the filling of the piston cylinder is poor. The result is a bad idle speed, high fuel consumption, low horsepower, and low torque at lower rpm. While the engine is working in both high and low rpm, the present invention makes the intake camshaft rotate, changing the angle between the intake and exhaust cams so that, therefore, it is possible to get better filling of the piston cylinder when the present invention causes the intake valve to open earlier, closing the angle between the intake and exhaust cams at high rpm. The present invention is preferably set to low rpm, which means that the angle between the intake and exhaust cams are at typical "factory" setting at low rpm, with a relatively wide angle between the intake and exhaust cams, causing the intake valve to open later. The present invention allows the angle between the intake or admission cams and the exhaust cams to be changed by merely applying longitudinal force to improve power and torque at high and low rpm, thus providing high horsepower and high torque at lower rpm, with low fuel consumption and good idle speed for city driving, and high horsepower and high torque at high rpm for highway or interstate driving.

Although the present invention has been described and illustrated with respect to a preferred embodiment and a preferred use therefor, it is not to be so limited since modifications and changes can be made therein which are within the full intended scope of the invention.

What is claimed is:

1. A camshaft rearranging device for an internal combustion engine including a crankshaft and a camshaft; said camshaft rearranging device comprising:

(a) first means for fixed attachment to said camshaft so that rotation of said first means will cause said camshaft to rotate; said first means including a first means gear member having at least one spiral tooth;

(b) second means for being rotated by said crankshaft; and (c) third means joining said first and second means to one another so that said first means will rotate when said second means is rotated by said crankshaft and for rotating said first means relative to said second means to rearrange the positional relationship of said camshaft relative to said crankshaft; said third means including a third means gear member having at least one spiral tooth for coacting with said spiral tooth of said first means gear member so that longitudinal movement of said third means gear member relative to said first means gear member will cause rotation of said first means gear member;

said third means including a plurality of spaced apart male members, and said second means having a plurality of spaced apart female members for slidably receiving said male members of said third means to secure said second and third means together in a manner which allows longitudinal movement of said third means relative to said second means while preventing rotation of said third means relative to said second means.

2. The camshaft rearranging device of claim 1 in which longitudinal movement of said third means relative to said first means causes rotation of said first means relative to said second means.

3. The camshaft rearranging device of claim 2 in which is included fourth means for causing longitudinal movement of said third means.

4. The camshaft rearranging device of claim 3 in which said fourth means includes motive power means for applying a longitudinal force to said third means.

* * * * *